US008117705B2

(12) United States Patent
Burenga

(10) Patent No.: US 8,117,705 B2
(45) Date of Patent: Feb. 21, 2012

(54) ROTARY BROOM WITH GEARBOX DRIVE

(75) Inventor: Thomas I. Burenga, Litchfield, IL (US)

(73) Assignee: Worksaver, Inc., Litchfield, IL (US)

( * ) Notice: Subject to any disclaimer, the term of this patent is extended or adjusted under 35 U.S.C. 154(b) by 0 days.

(21) Appl. No.: 12/931,697

(22) Filed: Feb. 8, 2011

(65) Prior Publication Data

US 2011/0203062 A1 Aug. 25, 2011

Related U.S. Application Data

(60) Provisional application No. 61/338,722, filed on Feb. 23, 2010.

(51) Int. Cl.
*E01H 1/05* (2006.01)

(52) U.S. Cl. ..... 15/82; 15/52.1; 180/53.1; 180/53.3; 180/53.7

(58) Field of Classification Search ..... 15/52.1, 15/78, 82, 87; 180/53.1, 53.3, 53.7; 74/11, 74/15.2, 606 R, 665 R
See application file for complete search history.

(56) References Cited

U.S. PATENT DOCUMENTS

| | | | | |
|---|---|---|---|---|
| 3,947,912 | A | | 4/1976 | Michaels |
| 3,952,359 | A | | 4/1976 | Rosseau |
| 3,995,415 | A | | 12/1976 | Hoffmann |
| 4,200,953 | A | | 5/1980 | Overton |
| 4,214,339 | A | | 7/1980 | Drumm |
| 4,267,616 | A | | 5/1981 | Hunt |
| 4,276,674 | A | | 7/1981 | Hunt |
| 4,328,014 | A | | 5/1982 | Burgoon et al. |
| 4,336,671 | A | | 6/1982 | Nelson |
| 4,369,540 | A | | 1/1983 | Burgoon et al. |
| 4,459,719 | A | | 7/1984 | Notestine |
| 4,580,312 | A | | 4/1986 | Van Raaij |
| 4,650,504 | A | | 3/1987 | Howeth |
| 4,674,143 | A | * | 6/1987 | Agergard et al. ..... 15/79.2 |
| 4,685,228 | A | * | 8/1987 | Gisler et al. ..... 37/197 |
| 4,701,969 | A | | 10/1987 | Berfield et al. |
| 4,708,723 | A | | 11/1987 | Howeth |
| 4,756,727 | A | | 7/1988 | Howeth |
| 4,802,983 | A | | 2/1989 | Howeth |
| 4,819,290 | A | | 4/1989 | Sculte |
| 4,864,674 | A | | 9/1989 | Hamilton |
| 5,020,664 | A | | 6/1991 | Hughes et al. |
| 5,093,955 | A | | 3/1992 | Blehert et al. |
| 5,279,014 | A | * | 1/1994 | Wise et al. ..... 15/82 |
| 5,423,394 | A | * | 6/1995 | Kendle ..... 180/53.3 |
| 5,426,805 | A | * | 6/1995 | Fisher ..... 15/79.2 |
| 5,427,192 | A | * | 6/1995 | Stephenson et al. ..... 180/53.1 |

(Continued)

*Primary Examiner* — Mark Spisich
*Assistant Examiner* — Michael Jennings
(74) *Attorney, Agent, or Firm* — Paul M Denk

(57) ABSTRACT

A rotary broom mounts upon a slotted plate that pivots upon a double gearbox. The broom has bristles upon an axle within a shield that receives power from a chain drive that receives its power from a driveline from a top gear box. The top gearbox orients in the direction of the chain driveline and delivers its power through an output shaft. The top gearbox joins to a slotted plate that turns in the same direction as the broom. The top gear box receives its power through an input shaft perpendicular to the output shaft. The top gearbox input shaft extends downwardly and becomes the output shaft of the bottom gearbox. The bottom gearbox has an input shaft that connects to a power take off. This rotary broom receives rotational power, rotates it 90° upwardly, then rotates it 90° downwardly and at an angle laterally to drive the broom.

7 Claims, 2 Drawing Sheets

U.S. PATENT DOCUMENTS 5,564,147 A * 10/1996 Young ..... 15/82
5,924,155 A 7/1999 Broz
5,951,782 A * 9/1999 Truitt ..... 134/21
6,006,390 A * 12/1999 Bischel et al. ..... 15/82
6,035,478 A * 3/2000 Miller et al. ..... 15/82
6,035,479 A * 3/2000 Basham et al. ..... 15/83
6,041,464 A * 3/2000 Ebersole ..... 15/83
6,088,865 A 7/2000 Truan et al.
6,098,387 A * 8/2000 Pfisterer ..... 56/16.4 R
6,202,243 B1 * 3/2001 Beaufoy et al. ..... 15/49.1
6,360,396 B1 * 3/2002 Chao ..... 15/82
6,446,297 B1 * 9/2002 Jackson ..... 15/82
6,536,067 B1 3/2003 Truan et al.
6,622,336 B2 * 9/2003 Jackson ..... 15/82
6,691,364 B1 2/2004 Truan et al.
6,920,661 B2 7/2005 Truan et al.
7,743,683 B2 * 6/2010 Dayton et al. ..... 81/52
7,753,148 B2 * 7/2010 Kokot et al. ..... 180/53.8
7,895,694 B2 * 3/2011 Fellinger ..... 15/23

* cited by examiner

ROTARY BROOM WITH GEARBOX DRIVE

CROSS REFERENCE TO RELATED APPLICATION

This non provisional patent application claims priority to the provisional patent application having Ser. No. 61/338,722, having filing date Feb. 23, 2010.

BACKGROUND OF THE INVENTION

The rotary broom with gearbox drive relates to mechanical equipment and more specifically to a rotary broom that operates at selected angles without the usage of a constant velocity joint and related drive line.

Parking lots, paving projects, construction sites, airports, farms, ranches, agricultural operations, and other projects often have large generally flat or gently curved surfaces. The surfaces often collect dust and other debris from the atmosphere, workers, equipment, and vehicles. From time to time, the surfaces require cleaning for safe usage or for preparation before application of another layer or lift of material. Workers, equipment, and vehicles that use a surface generally call for a minimum of debris impacting them. Particularly at airports, cleansing taxiways, aprons, and runways of debris is paramount to avoiding foreign object damage to aircraft engines and grounding of aircraft. After a harvest, a feeding operation, or an interval of usage, barns, stalls, sheds, and platforms along with other agricultural facilities require cleaning. Clean agricultural facilities lead to healthier and heavier livestock, greater dairy production, and higher quality harvested grain and vegetables.

When the surfaces are dry, the debris can be swept from the surface manually by a crew or more often by mechanical equipment. A crew utilizes many brooms pushed in formation through a facility, cleaning the floor of debris. However, this method has high labor costs and the crew likely tires before larger facilities are cleaned.

DESCRIPTION OF THE PRIOR ART

Over the years, equipment manufacturers have developed various surface cleaning implements. Implements wash surfaces, generally hard surfaces such as concrete and bituminous concrete. Implements also sweep surfaces removing debris by pushing from a blade, suction from a vacuum, brushing from a broom, and the like. Manufacturers have developed various rotary brooms with bristles along a central rotating shaft turned by the power take off from a tractor or electrical supply from a vehicle. Sweepster from Delhi, Iowa makes various brooms. The brooms attain an angle from the path of the vehicle ranging from to 30° right, 15° right, centered, 15° left through 30° left. The brooms pivotally connect to a vehicle so that the brooms follow the ground surface yet move upwardly upon encountering an obstacle or upon operator command. The brooms have a spring loaded chain extending to the vehicle that accommodates vertical changes in the broom, or floating. Brooms also must operate as the vehicle goes forward or reverse.

More particularly, Sweepster produces a broom upon a separate three point mounting frame that pivots both right and left. The broom has a head upon a main tube which accommodates floating of the broom during usage. The broom turns upon a drive line. The drive line extends from a vehicle, often a tractor, to a ninety degree gearbox upon the mounting frame. Then the drive line continues from the gear box to one side and on to a constant velocity joint, or CV joint. The CV joint handles the various angles of the drive line and floating however, CV joints wear prematurely in the absence of lubrication and replacement of a CV joint incurs significant labor costs. The drive line also has a ninety degree T shaft gearbox. This gearbox allows an operator to disconnect the various shafts of a driveline so that the broom can rotate either in forward or reverse. An operator disconnects all of the shafts from the T shaft gearbox, removes the gearbox from the mounting frame, inverts the gearbox 180°, secures the gearbox to the mounting frame, and reconnects all of the drive shafts so the broom rotates in the opposite direction.

Another manufacturer York Modern Corp. of Unadilla, N.Y. provides a broom that pivots during vertical floating. This broom pivots where its three point hitch pins connect to the lower lift arm of the typical tractor hitch. This broom has a gear box bolted to the main brush head frame. When an operator angles the broom during usage, the gear box attains the same angle. The York brooms include a driveline from the tractor, or other mover, power take off to the gearbox, a ninety degree gearbox in particular. Because the gearbox attains the same angle as the frame and the broom, the universal joints of the driveline also attain the angle of the gearbox. Angling the broom acutely also angles the driveline and its joints at that sharp angle as well. Joints operated at acute angles tend to wear prematurely.

For brooms upon three point hitches powered by a PTO, operators require that the brooms operate in both forward and reverse. In some usages, operators drive a tractor forward and the broom rotates forward. At other usages, operators drive a tractor in reverse and expect the broom to also rotate in reverse. Then in particular situations, operators drive a tractor in one direction and rotate the broom in the opposite direction.

The drive line also has a ninety degree T shaft gearbox. This gearbox allows an operator to disconnect the various shafts of a driveline so that the broom can rotate either in forward or reverse. An operator disconnects all of the shafts from the T shaft gearbox, removes the gearbox from the mounting frame, inverts the gearbox 180°, secures the gearbox to the mounting frame, and reconnects all of the drive shafts so the broom rotates in the opposite direction.

The present invention overcomes the disadvantages of the prior art and provides a rotary broom with a gearbox drive. This rotary broom operates in either a right or left angle without a CV driveline. The drivelines of the invention operate using drivelines at less than a 30° angle. The rotary broom allows for ready adjustment to a broom angle when the tractor moves forward or rearward. Operators of the rotary broom of this invention can make the adjustment using hand tools readily available to drivers, mechanics, farmers, ranchers, and growers.

SUMMARY OF THE INVENTION

Generally, the present invention is a rotary broom mounted upon a slotted plate that pivots upon a double gearbox. The broom includes bristles upon an axle within a shield. The axle receives power from a chain drive or other means upon one end. The chain drive receives its power from a driveline extending from a top gear box. The top gearbox orients in the direction of the chain driveline and delivers its power through an output shaft into the chain driveline. The top gearbox joins to the slotted plate that turns in the same direction as the angle of the broom. The top gear box receives its power through an input shaft generally perpendicular to the output shaft that drives the chain. The top gearbox input shaft extends downwardly and becomes the output shaft of the bottom gearbox.

The output shaft of the bottom gearbox and the input shaft of the top gearbox is generally vertical, that is, perpendicular to the rotational axis of the broom. The bottom gearbox has an input shaft that connects to a PTO of a tractor or other vehicle. The present invention receives rotational power from a PTO, rotates it 90° upwardly, then rotates it 90° downwardly and at an angle laterally to reach the driven end of the broom.

There has thus been outlined, rather broadly, the more important features of the invention in order that the detailed description thereof that follows may be better understood and that the present contribution to the art may be better appreciated. The present invention also includes a slotted guide plate, a pivotable gearbox, an invertable gearbox, and related framing supporting the guidebox and three point hitch connection. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the rotary broom with gearbox drive is to provide a broom that can be readily adjusted into a left or a right angle and attached to an existing three point hitch.

Another object of the rotary broom with gearbox drive is to provide such a gearbox drive that allows for ready detachment of a driveline.

Another object of the rotary broom with gearbox drive is to provide such a gearbox that allows for inversion of one gear box in relation to the other gearbox.

Another object of the rotary broom with gearbox drive is to provide such a gearbox drive that operates when the powered vehicle moves in forward or reverse.

Another object of the rotary broom with gearbox drive is to provide such a broom that can be installed with hand tools upon equipment readily available upon a farm, a ranch, or a jobsite.

Another object of the rotary broom with gearbox drive is to provide such a broom that has a low cost of manufacturing so the farmers, ranchers, contractors, operators, co-ops, haulers, elevators, yards, and depots can readily purchase the broom through existing sales outlets.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
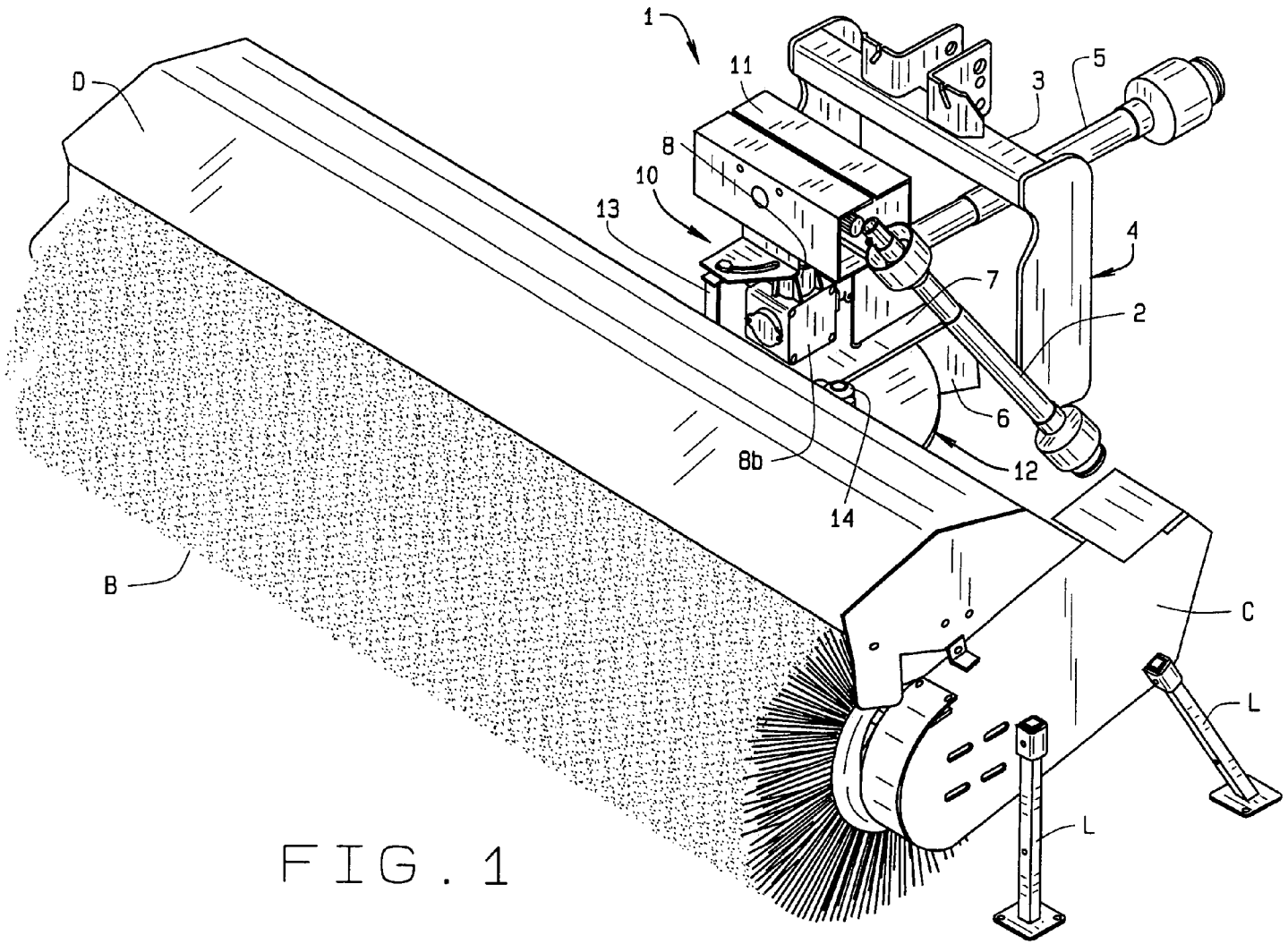
FIG. 1 shows an isometric view of the rotary broom with a gearbox drive of the present invention; and, FIG. 2 describes an exploded view of the framing and power train of the present invention.

The present invention overcomes the prior art limitations by providing a rotary broom with a gear box drive that readily changes from a right orientation to a left orientation and that supports a pivoting drive line that delivers power to the broom. The rotary broom 1 of this invention begins in FIG. 1 with a broom B formed of a plurality of bristles mounted upon a centered axis. The broom has an apparent cylindrical shape formed by the bristles. As the bristles wear during usage, the shape of the broom alters. From time to time, operators of the invention replace the bristles and at a longer time interval, operators rebuilding the broom from the axle outwardly. The broom has a cover D extending for the length of the broom and partially around the circumference, approximately one quarter to one third. The cover is generally located upwardly and rearwardly from where the broom engages a surface subject to cleaning. The broom receives power from a chain drive C generally upon one end of the broom, here shown in the foreground. The chain drive C receives its power from a constant velocity driveline 2, or CV driveline. The CV driveline has a generally elongated shaft with two ends. Each end has a universal joint with a short stub that provides for connecting the driveline to a power source or a power recipient. The universal joints allow for connection of the CV driveline to a power source and a power recipient spaced apart and angularly separated. The shaft of the driveline transmits power between the universal joints at each end. The CO driveline 2 connects to the assembly 3 of the present invention that supports the broom B and receives power from the source, such as a tractor, piece of equipment, or truck.

The assembly 3 begins with a frame 4 generally rectangular in shape and open. The frame supports a three point hitch connection between the invention and a vehicle, such as a tractor not shown. The frame is generally open to allow passage of a PTO driveline 5 from the tractor into the assembly. The frame has a tongue 6 extending generally perpendicular from the frame and opposite the PTO driveline 5. Spaced away and above the tongue, the assembly includes a base plate 7 that has a pattern of holes through it as later shown. Generally centered upon the base plate, the present invention includes a double gear box 8 having a top gear box, not shown, and a bottom gear box 8*b*, shown. The bottom gear box connects with the PTO driveline to receive power into the invention from the tractor. A shield 9 covers the connection of the bottom gear box to the PTO driveline. Forward of the bottom gear box and above the shield, a guide plate 10 attaches to the top gearbox as later shown. The guide plate includes an arcuate slot 10*c* therein. The slot has approximately 90° of curvature towards the direction of the chain drive of the invention. Above the guide plate, a two piece casing 11 covers the top gearbox.

Generally centered upon the broom and beneath the cover D, the present invention has a semi-circular pivot plate 12. The pivot plate 12 joins to the framing of the brush B and extends outwardly from the brush towards the frame 3. The pivot plate has a curved shape where the curved portion passes beneath the base plate 7 and above the tongue 6. The pivot plate rotates about a generally centered bolt connecting to the base plate and the tongue. Proximate to the center of the pivot plate's joint to the framing of the brush, the invention h as a stem 13 extending upwardly from the pivot plate, past the base plate, and nearly abutting the guide plate 10. The stem generally ends below the guide plate. The stem has a threaded aperture in its top that admits a bolt. During usage a bolt passes through the arcuate slot 10*c* of the guide plate 10 and secures to the top of the stem. Tightening of the bolt fixes the orientation of the brush framing at an angle desired by the operator of the vehicle. Upon loosening the bolt, the stem rotates beneath the arcuate slot 10*c* as the pivot plate turns upon the tongue when an operator pushes the brush framing. The pivot plate also includes a bumper 14 locating outwardly from the stem towards the chain drive C. The bumper extends into the pivot plate a short distance and prevents further turning of the pivot plate when it abuts the edge of the base plate. The bumper prevents an operator from turning the brush framing too far and snapping the CV driveline 2 or damaging the gear box 8.

Figure 2:
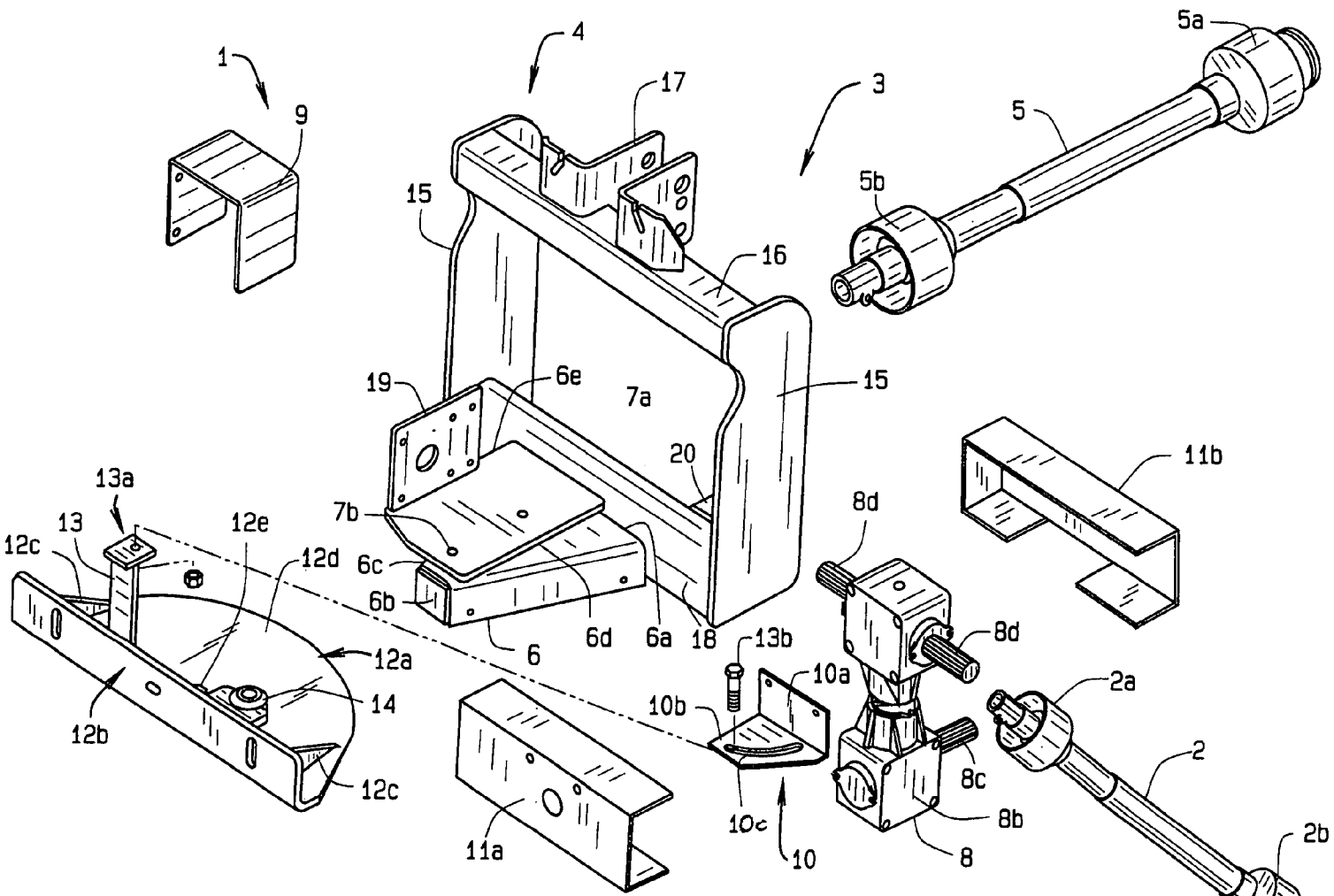

Having described the invention generally as assembled in FIG. 1, FIG. 2 shows the components of the present invention in more detail. The assembly 3 has its generally rectangular frame 4. The frame has two generally parallel and mutually spaced apart sides 15. The sides are generally rectangular in shape having a length, a longitudinal axis, two sides, and two ends perpendicular to the sides. One end is generally square and denotes the bottom being proximate to the surface being swept and the opposite end is curved with a slight concave edge in one side generally proximate the brush cover D. The longitudinal axis of the sides is generally upright, that is perpendicular to the surface being swept. The sides are joined by an upper member 16 that has a hitch clip 17 centered thereon. The hitch clip has a somewhat T like shape with a split web. The clip has a plurality of holes that allow for connection to various existing three point hitch systems. The upper member is generally elongated and of narrower width than a side 15. The upper member connects to the sides proximate the corner above the concavity as shown. Preferably, the upper member is tubular steel welded to steel sides. Opposite the upper member, the frame has a lower member 18 that spans between the sides generally parallel to the upper member. The lower member has a thickness less than the width of the side, here shown as approximately one half of the width of a side. The lower member connects to the sides proximate the bottom end and towards the brush framing. Preferably, the lower member is also tubular steel welded to steel sides. The upper member and the lower member have generally rectangular cross sections presenting a flat face towards the brush framing.

Outwardly from the lower member and generally opposite the hitch, the frame has the tongue 6. The tongue has a generally tapered shape with a wide base, 6*a*, locating upon the center of the lower member. Outwardly from the lower member, the tongue narrows in width to a tip, 6*b*, generally proximate the brush framing. The tongue has a thickness providing bending resistance as the tongue connects to the lower member in a cantilever manner. Above the tongue, the frame has the base plate 7. The base plate is generally in a plane parallel to the tongue and perpendicular to the lower member. The base plate has a generally rectangular shape with two short ends and two long sides perpendicular to the ends. The sides are approximately the same length as the tongue. As shown, one side, outwardly from the centerline of the tongue, is generally shorter than the other side. The ends and sides are proportional so that the base plate is generally not elongated. The base plate connects to the lower member slightly above the tongue, as at 6*c*, so that the pivot plate 12 may rotate between the base plate and the tongue during usage. The base plate includes a pivot hole 7*a* beneath which the pivot plate connects along its curved edge using a bolt and plurality of washers. The pivot hole locates away from the center of the tongue towards the lower member. Proximate the end of the tongue away from the frame, the base plate has a lock hole 7*b* that receives a pin, not shown, for securing the pivot plate, and hence brush, generally parallel to the frame. The base plate has its sides extending perpendicular to the lower member with the longer side, as at 6*d*, shown slightly off the centerline of the tongue towards the chain drive C leaving a portion of the tongue visible in this view. The remainder of the base plate extends away from the chain drive C. Perpendicular to the shorter edge, as at 6*e*, the baseplate 10 has a flange 19. The flange is welded to the base plate and is located away from the lower member at the corner of the base plate. The flange 19 has a plurality of holes allowing for connection of the gearbox as later described.

Behind the frame, that is, opposite the brush framing, the assembly includes a PTO driveline 5 that connects to a tractor or other equipment. The PTO driveline has a first end 5*a* and an opposite second end 5*b*. The first end connects with the PTO shaft from a tractor. The second end connects to the gear box as later described. The second end passes between the sides 15 of the frame 3 and extends over the baseplate 10 as previously shown in FIG. 1. The second end 5*b* of the PTO driveline receives protection from debris because of the shield 9. The shield is generally an inverted U shaped, cold formed steel member having two parallel flanges, or branches. Upon one flange, the shield has at least two holes for a bolted connection to the flange 19 generally near the lower member 18. The shield also provides protection to any operators proximate the gearbox 8 of the invention from the rotating second end 5*b* of the PTO driveline.

Generally opposite the shield 9 and the tongue 6, a gusset 20 spans from an end of the lower member 18 to the adjacent side 15 towards the chain drive C. The gusset is a cold formed steel member welded to the lower member and the side, providing further stiffness to the frame.

Turning inwardly from the frame, the present invention includes a double gear box 8 that has a top gearbox 8*a* and a bottom gearbox 8*b* beneath the top gearbox. The bottom gear box has an input shaft 8*c* extending outwardly from the gear box generally perpendicular to the lower member 18. As shown, the bottom gear box has a generally cube like shape with six face. Upon the face parallel to the input shaft and opposite the chain drive C, the bottom gear box has a plurality of holes that align with the holes in the flange 19 for a bolted connection. Meanwhile, the input shaft 8*c* connects to the second end 5*b* of the PTO driveline. The input shaft transmits power into the gearbox. The bottom gear box then rotates the power provided by the input shaft ninety degrees to an internal shaft, not shown, generally parallel to the plane of the sides 15 and perpendicular to the lower member 18. The internal shaft transmits the mechanical power into the top gear box 8*a*. The top gear box again rotates the power ninety degrees and divides it between two output shafts 8*d*. The two spaced apart output shafts 8*d* are generally coaxial along an axis parallel to the lower member 18 of the frame, that is, perpendicular to the input shaft 8*c* and the PTO drive line 5. As shown, one output shaft 8*d*, generally proximate the chain drive C, connects to a second end 2*b* of the brush driveline 2. This output shaft allows for rotating the brush towards the chain drive, or away from the flange 19. Opposite the second end 2*b*, the brush driveline 2 has a first end 2*a* that connects to the chain drive that drives the brush B.

As described earlier, the top gear box 8*a* can be removed from the internal shaft and rotated one hundred eighty degrees. This allows usage of the other output shaft 8*d*, away from the chain drive C, so that brush rotates away from the chain drive, or towards the flange 19. Similar to the bottom gearbox, the top gearbox has a cube like shape with six faces. Upon the face outwardly from the output shafts and opposite the upper member 16, the top gear box has at least two holes that allow for mounting of the guide plate 10.

The guide plate is generally a cold formed steel member having an angled cross section with two perpendicular legs 10*a*, 10*b*. An upper leg, as at 10*a*, is generally solid but for at least two holes that allow for a bolted connection of the guide plate to the top gearbox 8*a*. The lower leg, as at 10*b*, is perpendicular to the upper leg and generally opposite the holes of the upper leg. The lower leg is generally longer than the upper leg. The upper leg has a somewhat trapezoidal shape formed from removing one corner of a rectangular shape, the corner being away from the upper leg and toward the chain drive C as shown. The upper leg has an arcuate guide slot 10*c* fitting within the somewhat trapezoidal shape. The arcuate guide slot 10*c* has a curve extending through approximately ninety degrees of arc and a radius of curvature extending from a point where the upper and lower legs join generally opposite the chain drive C. As shown in the drawing, the arcuate guide slot is generally convex.

The top gearbox 8*a*, output shaft 8*d*, second end 2*b* of the driveline, and the upper leg 10*a* generally locate within the casing 11 as previously shown. The casing has a front casing as at 11*a* and an opposite rear casing 11*b*. The rear casing has a generally C shaped cross section with one open end proximate the chain drive C and an opposite closed end. The lower flange of the rear casing is notched upon the center to allow passage of the PTO driveline 5 beneath it. The front casing has a generally C shaped cross section also with one open end proximate the chain drive C and an opposite closed end. The web of the front casing has two holes proximate the upper flange for bolting to the top gear box above the upper leg 10*b* of the guide plate. Beneath the two holes, the web of the front casing has a large aperture that allows access to the top gearbox.

Outwardly from the gearbox 8 and the tongue 6, the present invention has the semi-circular pivot plate 12. The pivot plate has a generally semi-circular shape when viewed in plan, that is, when installed in the invention and looking downwardly behind the brush. The pivot plate has its semi-circular edge 12*a* locating inwardly, that is, towards the gear box. Opposite the semi-circular edge, the pivot plate has a straight edge, 12, generally upturned at a ninety degree angle. The straight edge defines the width of the pivot plate, generally the diameter of the semi-circular edge. The straight edge has reinforcement from two is gussets 12*c* welded from the straight edge to the semi-circular portion of the pivot plate. The gussets are generally perpendicular to both the semi-circular portion and the straight edge. Inwardly from the gussets, the straight edge has various apertures for mounting the straight edge to the framing of the brush B. inward from one gusset, here shown proximate to the gearbox, the straight edge has a bumper 14. The bumper extends in the same direction as the gusset, that is, towards the semi-circular edge 12*a*. The bumper joins to the straight edge, generally by welding, and presents a round wheel 14*a*. The wheel has a lesser diameter than the length of the bumper. The wheel adjoins the long edge 6*d* of the base plate 7 when the brush B is turned to the maximum angle permitted towards the chain drive. Along the straight edge and generally opposite the bumper, the pivot plate 12 includes a stem 13.

The stem generally joins to the upturned straight edge, preferably by welding, and extends well above the straight edge. The stem is generally perpendicular to the straight edge and the plane of the semi-circular portion of the pivot plate. Opposite the straight edge, the stem has a cap 13*a* welded on to it. The cap extends inwardly from the stem towards the semi-circular edge 12*a*. The cap is generally perpendicular to the remainder of the step and generally parallel to the plane of the semi-circular portion of the pivot plate. The cap has a threaded aperture inwardly from the stem that aligns with the guide slot 10*c* of the guide plate 10. During usage, an operator adjusts the angle of the brush B by rotating the brush framing towards the chain drive while the cap 13*a* passes beneath the guide plate along the path of the guide slot. A bolt 13*b* placed through the guide slot 10*c* into the threaded aperture of the cap secures the brush B at the desired angle. To reach the desired angle, the semi-circular portion of the pivot plate 12 has a pivot hole 12*d* generally centered upon the plate, away from the straight edge, and proximate the curved edge 12*b*. The pivot hole 12*d* is approximately midway along the spacing between the stem 13 and the bumper 14. The pivot hole 12*d* aligns with the pivot hole 7*a* in the base plate 7. The pivot plate turns upon a pin or bolt placed through the pivot hole in the base plate and the pivot hole in the pivot plate. This arrangement allows the pivot plate to rotate about an axis through the pivot hole 7*a* as it passes between the base plate 7 and the tongue 6. Inwardly from the pivot hole 12*d*, the pivot plate has a lock hole 12*e* that receive another pin or bolt placed through the outer hole 7*b* for locking the brush B generally perpendicular to the PTO driveline as during usage when the brush is perpendicular to the direction of motion of a vehicle.

From the aforementioned description, a rotary broom with gearbox drive has been described. The device is uniquely capable of repositioning a top gear box upon a bottom gear box so that a brush can rotate upon a tongue of a frame to achieve an angled orientation relative to the direction of movement of a vehicle supporting the brush. The device allows for temporarily fixing the angle of the brush using a slotted guide plate attached to the top gearbox. The device and its various components may be manufactured from many materials, including but not limited to, steel, ferrous and non-ferrous metals, their alloys, select polymers, and composites.

As such, those skilled in the art will appreciate that the conception, upon which this disclosure is based, may readily be utilized as a basis for the designing of other structures, methods and systems for carrying out the several purposes of the present invention. Heretofore, those skilled in the art have not recognized a double gear box and slotted guide plate allow for repositioning of a drive line in a rotary broom. Therefore, the claims include such equivalent constructions insofar as they do not depart from the spirit and the scope of the present invention.

I claim:

1. A rotary broom that pivots angularly in relation to input power, said broom including a brush of bristles upon an axle, the axle turning upon framing under power from a power take off of a vehicle, comprising:

a frame, generally open and rectangular, adapted to connect to a three point hitch from the vehicle, and adapted to admit a driveline from the power take off of the vehicle;

a double gear box having a bottom gear box and a top gear box locating above said bottom gear box, said double gear box connecting to said frame, said bottom gear box having an input shaft adapted to connect to the driveline from the power take off of the vehicle and an output shaft perpendicular to its input shaft and inserting into said top gear box, said top gear box receiving said output shaft of said bottom gear box and said top gear box rotating upon said output shaft of said bottom gear box;

a guide plate connecting to said top gear box outwardly from said frame, said guide plate having an arcuate slot therein;

a semi-circular pivot plate having a straight edge and an opposite arcuate edge, said straight edge of said pivot plate adapted to connect to the center of the framing of the brush, said pivot plate rotating about an axis perpendicular to the driveline from the power take off of the vehicle, said pivot plate pivotally connecting to said frame generally beneath said bottom gear box, said pivot plate slidably engaging said guide plate wherein said brush rotates through a predetermined angle;

a second driveline connecting to said top gear box and to the framing of said brush wherein said rotary broom transmits power from the driveline from the power take off of the vehicle through said gear box to said second driveline and to the axle of the brush; and, said top gear box, said second driveline, and said guide plate being capable of disconnection from the remainder of said broom wherein said broom has an orientation of one of to the left or to the right of the driveline from the power take off of the vehicle.

2. The pivoting rotary broom of claim 1 further comprising:

said frame having two mutually parallel and spaced apart sides generally parallel to said brush, a lower member spanning between said sides and locating beneath a driveline from the power take off of the vehicle, an upper member mutually parallel and spaced above said lower member and spanning between said sides and locating above a driveline from the power take off of the vehicle;

said frame having a tongue extending outwardly from said lower member generally opposite from the driveline of the power take off of the vehicle, said tongue being generally centered upon said lower member, and a base plate extending outwardly from said lower member and spaced above said tongue;

said pivot plate pivotally connecting to said tongue and passing between said base plate and said tongue wherein said pivot plate rotates through a predetermined angle.

3. The pivoting rotary broom of claim 2 further comprising:

said base plate having a generally planar rectangular shape, two spaced apart edges generally parallel to said lower member, and two mutually parallel and spaced apart longitudinal edges generally perpendicular to said lower member and a flange having a generally planar rectangular shape joining perpendicular to said base plate upon one longitudinal edge outwardly from said lower member and generally away from said bottom gear box; and, said base plate having a pivotal connection to said pivot plate.

4. The pivoting rotary broom of claim 3 further comprising:

a shield, having a generally inverted u shape, securing to said flange, and extending over the input shaft of said bottom gearbox;

said pivot plate having a first locked position wherein the straight edge is generally parallel to said lower member and a second locked position wherein said pivot plate has reached maximum rotation, said pivot plate locking to said base plate at either of said first locked position or said second locked position; and, said bottom gear box secures to said flange.

5. The pivoting rotary broom of claim 3 further comprising:

said pivot plate having a stem, offcenter upon said straight edge generally towards said flange, said stem extending perpendicular to said pivot plate; and, said stem abutting beneath said guide plate wherein said stem travels along said arcuate slot as said brush moves through a predetermined angle.

6. The pivoting rotary broom of claim 5 wherein said stem has a bolted connection to said mounting plate as a bolt passes through said arcuate slot.

7. The pivoting rotary broom of claim 1 further comprising:

said top gear box separating from said output shaft of said bottom gear box wherein said top gear box rotates approximately one hundred eighty degrees allowing rotation of said second driveline in either one of a clockwise or counterclockwise direction.

* * * * *